US005432033A

United States Patent [19]

Asanae et al.

[11] Patent Number: 5,432,033

[45] Date of Patent: Jul. 11, 1995

[54] METHOD OF ELECTROPHOTOGRAPHICALLY FORMING VISUAL IMAGE

[75] Inventors: Masumi Asanae, Kumagaya; Tadashi Kodama, Yokosuka; Yasuo Nozue, Yokosuka; Yoshihiro Noguchi, Yokosuka; Yoshiko Meguro, Yokohama, all of Japan

[73] Assignee: Hitachi Metals, Ltd., Tokyo, Japan

[21] Appl. No.: 221,604

[22] Filed: Apr. 1, 1994

[30] Foreign Application Priority Data

Apr. 1, 1993 [JP] Japan ..... 5-075509

[51] Int. Cl.[6] ..... G03G 15/02

[52] U.S. Cl. ..... 430/35; 355/219

[58] Field of Search ..... 430/31-35; 355/210, 211, 219

[56] References Cited

U.S. PATENT DOCUMENTS 3,816,840 6/1974 Kotz .

5,172,163 12/1992 Yamaoki et al. ..... 355/210

5,272,508 12/1993 Sakakibara et al. ..... 355/211 X 5,291,246 3/1994 Tsukamoto ..... 355/210

OTHER PUBLICATIONS

Abstract of JP 4-355465, Published Dec. 9, 1992.

Abstract of JP 4-116674, Published Apr. 17, 1992.

*Primary Examiner*—R. L. Moses

*Attorney, Agent, or Firm*—Finnegan, Henderson, Farabow, Garrett & Dunner

[57] ABSTRACT

There is provided an improved electrophotographic image-forming method in which a image-bearing member is charged by brushing a surface of the image-bearing member with a magnetic brush of a charging material containing a magnetic carrier having a volume specific resistance of less than $10^5$ Ω·cm. The present method causes no air pollution including generation of undesired by-products such as ozone, NOx, etc. The present method provides a toner image having high quality such as high resolution and high density without fogging on a background area of a recording sheet.

9 Claims, 1 Drawing Sheet

METHOD OF ELECTROPHOTOGRAPHICALLY FORMING VISUAL IMAGE

BACKGROUND OF THE INVENTION

The present invention relates to a method of electrophotographically producing a visual toner image on a recording sheet, and more particularly to an electrophotographic image-forming method by which a toner image having a high density, high resolution and therefore high quality can be produced on a recording sheet without formation of fogging, generation of undesired by-products such as ozone due to corona-discharging in charging section and/or transferring section, etc.

It is known that electrophotographic processes and electrostatic recording or printing methods are generally used to duplicate or reproduce an analog or digital data such as characters, graphics, etc. For instance, in an electrophotographic copying apparatus or facsimile, an electrostatic charge is produced on a photosensitive layer or dielectric layer and exposed to an image light to form a electrostatic latent image thereon. The latent image is developed by contacting a toner to form a visual toner image. Generally, the toners used there are those which are electrostatically charged to a proper polarity by a frictional contact with carrier particles according to a magnetic brush method, or magnetic toners which are composed primarily of a magnetic powder and a resin binder. However, in case such an electrophotographic image-forming method is adopted, the electrophotographic copying apparatus absolutely necessitates an electrostatic latent image-forming means including charging unit in addition to a light-illuminating means and a developing means to homogeneously charge a surface of an image-bearing member, resulting in complicated structure, large-scale equipment, etc.

U.S. Pat. No. 3,816,840 discloses a method in which a magnetic conductive toner is magnetically attracted to and retained on a sleeve made of a non-magnetic conductive material and a recording sheet is delivered between the sleeve and a recording electrode disposed in an opposed relation to the sleeve. When electric data signals are applied to the electrode, a latent image is formed on the recording sheet and simultaneously the magnetic toner is transferred to the recording sheet.

Regarding such direct recording methods, there has been many other proposals, all of which, however, are concerned with electrically recording methods using a recording electrode and a counter electrode opposed thereto. To obtain better recorded images, these methods must be carried out under a variety of strictly selected conditions including a gap between both electrodes, an amount of toner supplied to the recording sheet, etc. When a plain paper is used as the recording sheet, a surface potential of the paper is considerably affected by environmental conditions such as a moisture, a temperature and the like. Therefore, since developing parameters must be adjusted depending on the environmental conditions, the direct recording methods using plain papers as the recording sheet has not yet been reduced into practice.

On the other hand, there has been proposed a method in which an image light corresponding to an original image is illuminated from a back side of a light-transmittable image-bearing member to form an electrostatic latent image on a surface of the image-bearing member, and the latent image is developed simultaneously by selectively attracting thereon a magnetic conductive toner which is supplied by a developing roller composed of a permanent magnet and a sleeve. The developed image is then transferred and fixed onto a recording sheet. However, the above-mentioned recording method has adopted a corona discharger for imparting an electrostatic charge to the image-bearing member in a charging section and a transferring section. Since the corona discharger employs a metal wire applied with a high voltage such as D.C. 5–8 kV, undesired by-products including ozone, nitrogen oxides (NOx), etc. are generated upon corona discharging. This leads to air pollution such as generation of discomfortable odor, etc. The by-products produced due to the corona discharging might cause deterioration of the image-bearing member, obscure or deteriorated toner image, etc. The corona discharger has a large power consumption because only 5–30% of an electric current supplied thereto is utilizable for the charging. Further, if the metal wire of the corona discharger is stained, the toner images having low quality such as lost or lacked toner images, undesired toner lines, etc. are produced. In the transferring section, the corona discharger is disposed on a back side of the recording sheet and applies a charge having a different polarity from that of the image-bearing member to the developer through the recording sheet, thereby transferring the toner image to the recording sheet. As a result, the transferring process is considerably affected by an ambient moisture which causes change in an electrical resistance of the recording sheet. If the resistance of the recording sheet is low, the transferring of the toner images is undesirably prohibited.

Furthermore, there has been proposed a method in which the image-bearing member is electrostatically charged by brushing with a fur brush. The charging system has such a defect that residual toner and fogging toner are brushed together, resulting in contaminating the surface of the image-bearing member and therefore deterioration in quality of subsequently produced toner images.

OBJECT AND SUMMARY OF THE INVENTION

Accordingly, an object of the present invention is to provide an improved method of electrophotographically producing a visual toner image on a recording sheet, by which a toner image having high resolution, high density and therefore high quality is obtained.

Another object of the present invention is to provide an improved method of electrophotographically producing a visual toner image on a recording sheet, which is prevented from generation of undesired by-products such as ozone, NOx, etc.

As a result of intense investigations by the inventors, it has been found that a volume specific resistance of the charging material is a determinate factor for obtaining a toner image having an improved quality such as high image resolution, high image density, etc. The present invention is derived from and based on the findings.

Thus, the present invention provides a method of electrophotographically producing a visual image corresponding to an original image on a recording sheet, including: (1) forming an electrostatically charged area on a movable image-bearing member including a light-transmittable photosensitive layer; (2) moving the electrostatically charged area of the image-bearing member to a developing zone where the charged area of the image-bearing member is opposed to a developing roller composed of a hollow cylindrical non-magnetic material sleeve and a permanent magnet disposed within said sleeve and having a plurality of magnetic poles on the surface; (3) supplying a magnetic developer composed of a magnetic toner and magnetic carrier to a gap between the sleeve of the developing roller and the image-bearing member by a relative rotational movement of the sleeve and the permanent magnet; (4) irradiating an image light from a back side of the image-bearing member to the charged area of the image-bearing member to form a latent image thereon; (5) developing said latent image by contact with the magnetic developer supplied by the developing roller; and (6) transferring the developed image onto a recording sheet, wherein a charging roller made of permanent magnet having a plurality of magnetic poles on the surface is disposed on an upstream side of the developing roller and in an opposed relation to said image-bearing member, and wherein said electrostatically charged area is formed on the image-bearing member to brush a surface of the image-bearing member with a magnetic brush formed by a charging material attracted onto a surface of the charging roller, said charging material including a magnetic carrier having a volume specific resistance of less than $10^5$ Ω·cm.

DETAILED DESCRIPTION OF THE INVENTION

Figure 1:
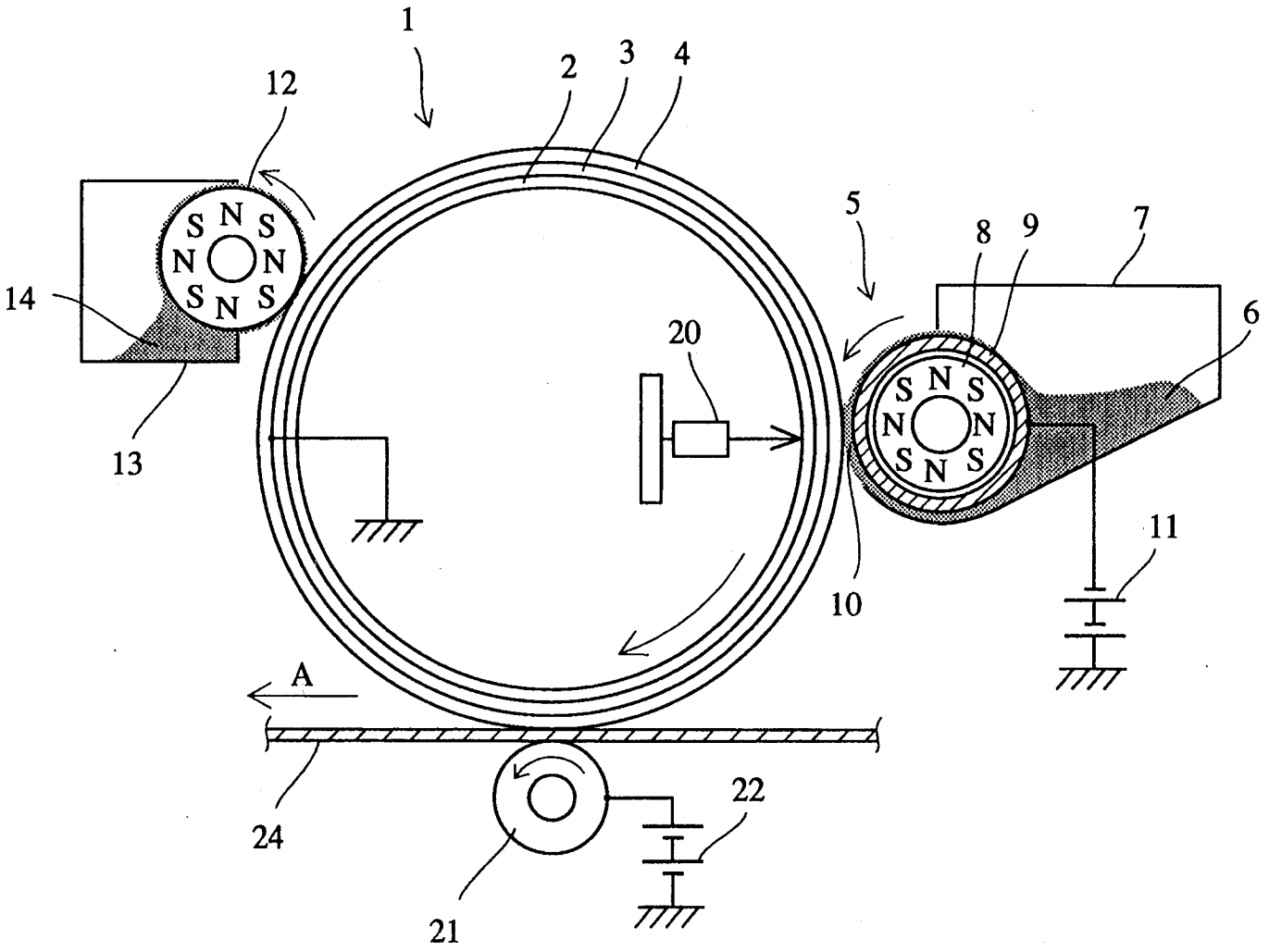
FIG. 1 is a schematic side view showing one example of an electrophotographic recording apparatus accomplishing a method according to the present invention.

The present invention will be described in detail below.

First, the overall structure of an electrophotographic recording apparatus applicable to accomplish the present method will be explained with reference to the attached drawing.

Overall Structure of Apparatus

Referring to FIG. 1, a hollow cylindrical image-bearing member 1 includes a cylindrical support 2 made of a light-transmittable material such as glass, a light-transmittable conductive layer 3 formed on the support 2, and a photosensitive layer 4 made of a light-transmittable photoconductive material and formed on the conductive layer 3. The image-bearing member 1 is rotated by a driving means (not shown), for instance, in a clockwise direction as shown in FIG. 1. A protective coat made of a wear-resistant material may be formed on the photosensitive layer 4, if desired.

A developing unit is disposed in the vicinity of the image-bearing member 1 in an opposed relation thereto. The developing unit is composed of a hopper 7 accommodating a magnetic developer 6 and a developing roller 5 partially received in the hopper 7. The image-bearing member 1 and the developing roller 5 cooperate to define a developing gap therebetween, namely an image-forming zone 10 where a latent image on the image-bearing member is developed by a magnetic developer 6 to form a visual image. The developing roller 5 includes an inner permanent magnet 8 provided with a plurality of (eight) magnetic poles on the surface, and an outer hollow cylindrical sleeve 9 made of a non-magnetic material such as aluminum alloy, austenitic stainless steel, etc. The outer sleeve 9 is disposed coaxially with the inner permanent magnet 8. The developer 6 is delivered from the hopper 7 to the image-forming zone 10 by a relative rotational movement of the inner permanent magnet 8 and the outer sleeve 9. In addition, the sleeve 9 is electrically connected with a bias voltage source 11 so that a bias voltage is applied to the sleeve 9.

A charging unit is also disposed in the vicinity of and on an upstream side of the image-bearing member 1. The charging unit includes a hopper 13 accommodating a charging material 14 therein and a charging roller 12 made of a permanent magnet. The charging roller 12 is partially received in the hopper 13 and disposed at its opposite side in facing relation to the image-bearing member 1. When the charging roller 12 is rotated, the charging material composed of a magnetic toner and a magnetic carrier is attracted on the surface of the charging roller 12 to form a so-called magnetic brush by which a surface of the image-bearing member 1 is slidingly brushed.

The charging roller 12 is preferably constituted by a cylindrical permanent magnet having a plurality of magnetic poles on the surface. The plurality of magnetic poles are arranged in equi-distantly spaced relation along an outer circumferential surface of the roller and extends in the axial direction of the roller. Alternatively, the charging roller may be constructed by disposing a plurality of rectangular permanent-magnet blocks along the circumferential surface of a cylindrical core shaft.

A light-emitting means 20 is mounted inside the image-bearing member 1 in an opposed relation to the image-forming zone 10 to emit a light signal corresponding to an original image to be printed to the outer surface of the image-bearing member 1.

A transfer roller 21 made of a conductive material such as copper, copper alloy, etc. is electrically connected to a grounded bias voltage source 22 and rotatably disposed in a pressure-contact with the image-bearing member 1. A recording sheet 24 is supplied between the image-bearing member 1 and the transfer roller 21 in a direction indicated by an arrow A and further delivered to a fixing unit (not shown).

When the transfer roller 21 is constituted as a slip-transfer means, the roller may be composed of a core made of a rigid material such as metal and a coating layer made of an elastic material such as rubber. This generates a slight relative slide movement between the image-bearing member 1 and the recording sheet 24. On the other hand, when the transfer roller 21 is constituted as a pressure-transfer means, the roller 21 may be composed of a metal core and a hard coating layer or only metal core so that a small amount of nip is generated between the image-bearing member 1 and the recording sheet 24. Furthermore, when the toner image is electrostatically transferred onto the recording sheet 24, a conductive rubber roller is used as the transfer roller 21.

Operation of Apparatus

With the electrophotographic recording apparatus energized, the charging roller 12 is rotated so that the magnetic brush is formed around the charging roller 12 by attracting the charging material 14 thereon. The surface of the image-bearing member 1 is brushed by the magnetic brush to form an electrostatically charged area thereon. On the other hand, the developing roller 5 is also rotated to supply a magnetic developer 6 from the hopper 7 to the image-forming zone 10. Upon rotation of the image-bearing member 1, the electrostatically charged area on the image-bearing member 1 is moved to the image-forming zone 10. Since a magnetic brush is also formed on the developing roller 5, the electrostatically charged area on the surface of the image-bearing member 1 is slidingly brushed or rubbed-off by the magnetic brush formed around and extending axially of the developing roller 5, thereby triboelectrifically charging the surface of the image-bearing member 1 and imparting an additional electrostatic charge thereto.

The light-emitting means (LED array) 20 emits a light beam having light signals corresponding to the original image to be printed. The light beam emitted is directed from the back side of the image-bearing member 1 to the electrostatically charged area on the surface of the image-bearing member 1 so that an electrostatic charge of a light beam-irradiated part of the area is dissipated while a remaining part not irradiated by the light beam is kept electrostatically charged. As a result, a difference in potential is produced between the part irradiated by the light beam and the developing roller 5, while no difference in potential is produced between the remaining part not irradiated and the developing roller 5. Consequently, the developer 6 is attracted to the part irradiated by the light beam to form a visual toner image thereon. The developed toner image is delivered by a further rotation of the image-bearing member 1 to a transfer zone where the toner image is transferred onto the recording sheet 24 delivered between the image-bearing member 1 and a transfer roller 21. The recording sheet 24 having the transferred toner image is then delivered to a fixing means (not shown) to obtain the fixed toner image.

The details of developer and charging materials used to accomplish the present method are described below.

Charging Material (a) Magnetic Carrier

The magnetic carrier used in the charging material has a volume specific resistance of less than $10^5$ Ω·cm. When the volume specific resistance of the magnetic carrier is $10^5$ Ω·cm or greater, a sufficient charging potential is not attained on the surface of the image-bearing member 1.

Suitable examples of such a magnetic carrier include those used as a carrier in two component-type developer. For instance, an iron powder, particulate ferrite such as Ni-Zn ferrite, Mn-Zn ferrite and Cu-Zn ferrite, magnetite particles, etc. are involved therein. The magnetic carrier preferably has an average particle size of 10–200 μm, which can be also granulated from fine particles with a particle size of 5 μm or smaller. Although such particles are usable alone, the magnetic carrier is preferably coated with a resin layer such as silicone resins, fluorocarbon resins, styrene resins, polyester resins, epoxy resins or the mixture of these resins. Alternatively, the magnetic carrier and the resin binder may be mixed together and formed into composite particles. Further, conductive particles such as carbon black may be added and adhered to the surface of the resin-coated carrier or the core particle.

A content of the magnetic carrier in the charging material is generally 50 weight % or greater, preferably 60 weight % or greater.

(b) Magnetic Toner

The magnetic toner used in the magnetic charging material of the present invention has preferably an average particle size of 5–20 μm, more preferably 6–16 μm. When a particle size of the toner is too small, there occurs inconvenience such as fogging on a background area of the recording sheet, splashing of toner, etc. On the other hand, when the particle size is too large, resolution and developability of the toner image are undesirably lowered. The magnetic toner suitably includes a magnetic powder made of compounds or alloys containing ferromagnetic components such as ferrites, magnetites or other iron alloys, cobalt, nickel, etc. To homogeneously disperse the magnetic powder in the magnetic toner, the powder has preferably an average particle size of 0.01–3 μm and a proportion of 10–75 weight % based on a total amount of the magnetic toner and magnetic powder. A volume specific resistance of the magnetic toner is preferably $10^{12}$ Ω·cm or greater. If the volume specific resistance of the magnetic toner is less than $10^{12}$ Ω·cm, charging and transferring processes can not satisfactorily conducted due to its low chargeability.

A binder component of the magnetic toner is preferably those mentioned below.

When a heat-fixing system using an oven or heat roller is employed, suitable examples of the binder for the magnetic toner are, for instance, thermoplastic vinyl resins including homopolymers produced by polymerization of monomers such as styrenes, vinyl esters, esters of α-methylene-aliphatic monocarboxylic acids, acrylonitrile, methacrylonitrile, acrylamides vinyl ethers, vinyl ketones, N-vinyl compounds, etc., copolymers of two or more monomers mentioned above, or a mixture thereof. Further, non-vinyl resins such as non-vinyl thermoplastic resins including bisphenol-type epoxy resins, oil-modified epoxy resins, polyurethane resins, cellulose resins, polyether resins, polyester resins, etc. may be used alone or in combination with the above mentioned thermoplastic vinyl resins.

When the pressure-fixing system is employed, suitable examples of the binder for the magnetic toner are, for instance, pressure-sensitive resins such as higher aliphatic acid resins, higher aliphatic acid derivative resins, higher aliphatic acid amide resins, waxes, rosin derivative resins, alkyd resins, epoxy-modified phenol resins, natural resin-modified phenol resins, amino resins, silicone resins, urea resins, copolymeric oligomers of acrylic or methacrylic acid and long-chain alkylmethacrylate or alkylacrylate, polyolefins, ethylene/vinylacetate copolymers, ethylene/vinylalkylether copolymers, maleic acid anhydride-type copolymers, etc. These resins are optionally selected and utilizable alone or in combination. However, to prevent a deterioration of flowability of the toner, it is preferred that the resins or resin mixtures used have a glass-transition temperature of greater than 40° C.

The other components such as pigments, dyes, etc. used in the dry developer may be contained in the magnetic toner. A preferred proportion of the other components added is 10 weight % or less.

A content of the magnetic toner in the charging material is generally in range of 0–50 weight %, preferably 5–50 weight %, more preferably 10–40 weight %.

The magnetic toner can be prepared by kneading the raw materials under a heating condition, cooling and hardening, then pulverizing and classifying to obtain toner particles having a predetermined particle size.

Developer (a) Magnetic Carrier

The magnetic carrier used in the magnetic developer has preferably an average particle size of 10–100 μm and a volume specific resistance of $10^5$–$10^{10}$ Ω·cm, more preferably $10^7$–$10^9$ Ω·cm. Suitable examples of such a magnetic carrier include, for instance, particles made of ferromagnetic materials having the above-mentioned characteristic, a dispersion of the ferromagnetic material in a resin binder, etc. Among them, magnetite and ferrite are preferable. The magnetic carrier may be used with or without a resin coat layer. Suitable material for the resin coat layer includes monomers, copolymers or modified compounds of silicone resins, styrene-acrylic acid resins, polyester resins, maleic acid resins, acrylic acid resins, etc. To strongly bind the resin coat layer onto the magnetic carrier, a hardening agent may be added to the resins. Suitable hardening agents include thermosetting compounds such as melamine and other amine salts. Further, to improve a bindability to magnetic carrier particles, wear-resistance, fusion-resistance, chargeability and flowability, the resin coat layer may include a small amount of phenol resins, urea resins, alkyd resins and other additives such as fillers, diluents, plasticizers, etc.

(b) Magnetic Toner

The same magnetic toner as used in the charging material, is also applicable as a magnetic toner for the magnetic developer. A content of the magnetic toner in the magnetic developer is preferably in range of 10–95 weight %, preferably 10–40 weight %.

The present invention will be described in more detail by way of the following examples without intention of restricting the scope of the present invention.

The components used in examples were prepared as follows:

REFERENCE EXAMPLE 1

Preparation of Charging Material (1) Preparation of Magnetic Toner 44 parts by weight of styrene-n-butylmethacrylate (number average molecular weight (Mn)$=1.6\times10^4$, weight average molecular weight (Mw)$=21\times10^4$), 50 parts by weight of magnetite (EPT500 manufactured by Toda kogyo K.K.), 5 parts by weight of polypropylene (BISKOL550P manufactured by Sanyo Kasei Kogyo K.K.) and 1 part by weight of a negative charging agent (Bontron E-81 manufactured by Orient Chemical Industries) were mixed by a kneader equipped with a heating roller. After cooling and solidifying, the mixture was pulverized and classified to obtain a negative magnetic toner having an average particle size of 10 μm. In a hot air flow having a temperature of 120° C., 0.5 parts by weight of hydrophilic silica (R972 manufactured by Nippon Aerozil K.K.) was added to the magnetic toner obtained above so that the magnetic toner was coated with the hydrophilic silica. The coated toner had a volume specific resistance of $10^{14}$ Ω·cm and a triboelectric charge of −15 μc/g.

Incidentally, the above volume specific resistance was determined in such a manner that an appropriate amount (ten-odd mg) of the magnetic toner was scaled and sampled by a balance and charged into a dial-gauge type cylinder made of Teflon (trade name) and having an inner diameter of 3.05 mm. The sampled magnetic toner was exposed to an electric field of D.C. 4000 V/cm under a load of 0.1 kg to measure an electric resistance of the magnetic toner using an insulation-resistance tester (4329 type tester manufactured by Yokogawa Hewlett Packard K.K.). On the other hand, to measure the triboelectric charge of the sampled magnetic toner, a developer having a toner content of 5 weight % was prepared by intimately mixing the magnetic toner with carrier particles described below, and blown at a blowing pressure of 1.0 kgf/cm$^2$. The measurement of the triboelectric charge was measured by using a blow-off powder electrified charge measuring apparatus (TB-200 manufactured by Toshiba Chemical K.K.).

(2) Preparation of Magnetic Carrier 100 parts by weight of Mg-Zn ferrite carrier (KBN-120 manufactured by Hitachi Metals, Ltd.) was mixed with 3 parts by weight of a silicone resin. The mixture was heat-treated at 70° C. for 30 minutes in a fluidized bed coating apparatus. After cracking, the heat-treated mixture was classified to obtain a resin-coated magnetic carrier having an average particle size of 30 μm. Thereafter, 2 parts by weight of carbon black (#44 manufactured by Mitsubishi Kasei K.K.) was added to the magnetic carrier, thereby adhering the carbon black onto the resin coat. A volume specific resistance of the magnetic carrier was $5\times10^3$ Ω·cm. The volume specific resistance of the magnetic carrier was determined by the same method as used in preparation of the magnetic toner except that the sampled carrier was exposed to an electric field of D.C. 100 V/cm instead of D.C. 4000 V/cm.

(3) Preparation of Charging material

The magnetic toner and magnetic carrier thus obtained were mixed together to produce charging materials having the carrier contents shown in Table 1.

REFERENCE EXAMPLE 2

Preparation of Magnetic Developer

Reference Example 1 was repeated except that the same magnetic toner as in Reference Example 1 was mixed with Ba-Ni-Zn ferrite carrier (KBN-100 manufactured by Hitachi Metals, Ltd.) as a magnetic carrier to obtain a magnetic developer having a toner content of 30 weight %. Incidentally, the ferrite carrier had an average particle size of 70 μm and a volume specific resistance of $10^9$ Ω·cm.

EXAMPLE 1

The magnetic charging material and magnetic developer produced above were respectively charged into a charging unit and developing unit of an electrophotographic printer having such a structure as shown in FIG. 1. A formation of a toner image was carried out under the charging, developing, transferring and fixing conditions mentioned below.

In the charging unit, a doctor gap between the charging roller 12 and doctor blade (not shown) was adjusted to 0.3 mm to form a layer of the charging material 14 with an adequate thickness on the charging roller 12. A charging gap between the charging roller 12 and the image-bearing member 1 was adjusted to 0.4 mm. The charging roller 12 having an outer diameter of 18 mm was made of a permanent magnet (YBM-3 manufactured by Hitachi Metals, Ltd.). The charging roller 12 had a surface magnetic flux density of 750 G and was rotated at 1000 rpm.

A doctor gap between the developing roller 5 and doctor blade (not shown) was adjusted to 0.3 mm to form a layer of the developer with an appropriate thickness on the developing roller 5. A developing gap between the developing roller 5 and image-bearing member 1 was adjusted to 0.4 mm. The developing roller 5 was composed of a hollow cylindrical sleeve 9 made of stainless stool (8US304) and having an outer diameter of 20 mm, and a permanent magnet disposed within the sleeve 9 and having eight poles on the surface. A surface magnetic flux density on the sleeve 9 was 700 G and a rotation speed of the sleeve was adjusted to 150 rpm. The sleeve 9 was further applied with a bias voltage of −360 V.

The image-bearing member 1 made of a negative photosensitive material and having an outer diameter of 40 mm was rotated at a peripheral speed of 50 mm/second.

A heating roller (not shown) was used as fixing means and a fixing temperature was adjusted to 190° C. The heating roller was pressed to the recording sheet 24 at a line pressure of 1 kg/cm.

Using the electrophotographic printer thus adjusted, image-forming procedures were carried out with a charging material having a carrier proportion of 100 weight %. A surface potential of the image-bearing member 1 was −400 V. Image density and fogging density of the toner image were determined from reflectance optical densities thereof.

The results are shown in Table 1.

EXAMPLES 2–3

Example 1 was repeated except that proportions of the magnetic carrier in the charging material were changed to 90 weight % in Example 2 and to 50 weight % in Example 3. Surface potential of the image-bearing member 1 was −400 V in both Examples. The image densities and the fogging densities are also shown in Table 1.

COMPARATIVE EXAMPLES 1–3

Comparative Examples 1–3 were conducted in the same manner as in Examples 1–3, respectively, except that the magnetic carrier without the outer resin coat was used in the charging material. The surface potential of the image-bearing member 1 was −250 V. The image densities and the fogging densities are also shown in Table 1.

TABLE 1

| | Magnetic Carrier in Charging Material | | | | |
|---|---|---|---|---|---|
| No. | Volume Specific Resistance (Ω · cm) | Content (Weight %) | Surface Potential | Image Density | Fogging |
| Example 1 | $5 \times 10^3$ | 100 | −400 V | 1.2 | 0.06 |
| Example 2 | $5 \times 10^3$ | 90 | −400 V | 1.4 | 0.06 |
| Example 3 | $5 \times 10^3$ | 50 | −400 V | 1.4 | 0.30 |
| Com.Ex. 1 | $1 \times 10^8$ | 100 | −250 V | 0.8 | 0.35 |
| Com.Ex. 2 | $1 \times 10^8$ | 90 | −250 V | 1.0 | 0.28 |
| Com.Ex. 3 | $1 \times 10^8$ | 50 | −250 V | 0.2 | 0.51 |

As is apparently noted from Table 1, the image-forming process in Examples 1–3 can provide higher surface potentials, higher image densities and lower fogging than those in Comparative Examples 1–3. Further, as a content of magnetic carrier in the charging material became low, the fogging was likely to be generated. Therefore, it was confirmed that the preferred content of the magnetic carrier in the charging material was 60 weight % or greater.

What is claimed is:

1. A method of electrophotographically forming a visual image corresponding to an original image on a recording sheet, including: (1) forming an electrostatically charged area on a movable image-bearing member made of a light-transmittable photosensitive material; (2) displacing the electrostatically charged area of the image-bearing member to a developing zone where the charged area of the image-bearing member is opposed to a developing roller composed of a hollow cylindrical sleeve made of non-magnetic material and a permanent magnet disposed within said sleeve and having a plurality of magnetic poles on the surface thereof; (3) supplying a magnetic developer into a gap between the sleeve of the developing roller and the image-bearing member by a relative rotational movement of the sleeve and the permanent magnet; (4) irradiating an image light from a back side of the image-bearing member to the charged area to form a latent image on the image-bearing member; (5) developing said latent image by contact with the magnetic developer supplied by the developing roller, said irradiation of the image light and said developing of the latent image being performed substantially at the same time; and (6) transferring the developed image onto a recording sheet, wherein a permanent magnet charging roller having a plurality of magnetic poles on the surface thereof is disposed on an upstream side of the developing roller and in an opposed relation to said image-bearing member, and wherein said electrostatically charged area is formed on the image-bearing member by brushing a surface of the image bearing member with a magnetic brush formed by a charging material attracted onto a surface of the charging roller, said charging material including a magnetic carrier having a volume specific resistance of less than $10^5$ Ω·cm.

2. The method according to claim 1, wherein said magnetic carrier of the charging material is an iron powder, particulate Ni-Zn ferrite, particulate Mn-Zn ferrite, particulate Cu-Zn ferrite or particulate magnetite.

3. The method according to claim 1, wherein a proportion of said magnetic carrier in the charging material is 60 weight % or greater.

4. The method according to claim 1, wherein said magnetic carrier is coated with a resin layer.

5. The method according to claim 1, wherein said magnetic carrier is in the form of composite particles each of which is made from a mixture of the magnetic powder and a resin binder.

6. The method according to claim 4, wherein carbon black is attached onto a surface of the magnetic carrier.

7. The method according to claim 1, wherein said charging material includes a magnetic toner in a proportion of 10–40 weight % based on a total amount of the charging material.

8. The method according to claim 7, wherein said magnetic toner has an average particle size of 6–16 μm.

9. The method according to claim 1, wherein said magnetic developer includes a magnetic carrier having an average particle size of 10–100 μm and a volume specific resistance of $10^7$–$10^9$ Ω·cm.

* * * * *